US009920539B1

(12) United States Patent
Butts

(10) Patent No.: US 9,920,539 B1
(45) Date of Patent: Mar. 20, 2018

(54) ADJUSTABLE ARCH MEASURING TOOL AND ASSOCIATED USE THEREOF

(71) Applicant: Robert Butts, Jacksonville, FL (US)

(72) Inventor: Robert Butts, Jacksonville, FL (US)

( * ) Notice: Subject to any disclaimer, the term of this patent is extended or adjusted under 35 U.S.C. 154(b) by 115 days.

(21) Appl. No.: 15/152,466

(22) Filed: May 11, 2016

Related U.S. Application Data

(60) Provisional application No. 62/159,456, filed on May 11, 2015.

(51) Int. Cl.
*B43L 7/10* (2006.01)
*E04F 21/00* (2006.01)

(52) U.S. Cl.
CPC ..... *E04F 21/003* (2013.01)

(58) Field of Classification Search
CPC ..... B43L 7/10
USPC ..... 33/194, 452, 465, 469
See application file for complete search history.

(56) References Cited

U.S. PATENT DOCUMENTS 845,009 A * 2/1907 Novak ..... B43L 7/12 33/43
RE13,541 E * 3/1913 Robins ..... 33/465
1,994,401 A * 3/1935 Heinrich ..... B43L 13/10 33/452
2,110,636 A * 3/1938 Sharp ..... G01B 3/56 33/465
2,274,582 A * 2/1942 Bauer ..... B43L 7/12 33/495
2,548,350 A * 4/1951 Combs ..... E04F 21/26 33/469
2,611,185 A * 9/1952 Thursack ..... B25H 7/00 33/469
3,269,015 A * 8/1966 Barker ..... G01B 3/00 33/27.08
4,348,815 A 9/1982 Hurt
4,922,621 A 5/1990 Maier
5,163,228 A * 11/1992 Edwards ..... A61B 5/107 33/1 N
5,713,135 A 2/1998 Acopulos
6,725,555 B1 * 4/2004 Moore ..... B25H 7/00 33/423
7,254,899 B2 8/2007 Marocco
2002/0053142 A1 * 5/2002 Brunetti ..... B25H 7/00 33/194
2005/0050813 A1 3/2005 McAree
(Continued)

*Primary Examiner* — G. Bradley Bennett
(74) *Attorney, Agent, or Firm* — Najafi Law, PA; Ashkan Najafi

(57) ABSTRACT

An adjustable arch measuring tool measures an arcuate curvature of one of a window and a door and thereby assists a user to layout a radius of the arcuate curvature on an existing cutting surface. The adjustable arch measuring tool includes a first member having an arcuate slot defining an adjustable fulcrum axis formed at a proximal end thereof, a second member having an aperture formed at a proximal end thereof, and a fastener removably inserted through the aperture and selectively locked along a curvilinear longitudinal length of the arcuate slot. Advantageously, the second member is selectively pivoted about the adjustable fulcrum axis defined along the arcuate slot of the first member. With the use of reference points and guide pins, each half of the arch can be easily drawn directly on the working surface.

19 Claims, 8 Drawing Sheets

(56) References Cited

U.S. PATENT DOCUMENTS

| | | | | |
|---|---|---|---|---|
| 2006/0174503 | A1* | 8/2006 | Johnson | B43L 7/005 33/471 |
| 2009/0139104 | A1* | 6/2009 | Rohweder | B25H 7/00 33/478 |
| 2010/0043243 | A1* | 2/2010 | Li | B43L 7/10 33/471 |
| 2014/0373372 | A1* | 12/2014 | Flippo | B43L 7/10 33/418 |
| 2017/0153101 | A1* | 6/2017 | Ostachowski | B43L 7/10 |

* cited by examiner

ADJUSTABLE ARCH MEASURING TOOL AND ASSOCIATED USE THEREOF

CROSS REFERENCE TO RELATED APPLICATIONS

This is a non-provisional patent application that claims the benefit of U.S. provisional patent application No. 62/159,456 filed May 11, 2015, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to carpenter tools and, more particularly, to a hand-held tool for measuring an arcuate curvature associated with a window or door, for example, thereby assisting a user to layout the radius of the arcuate curvature on a cutting surface.

Prior Art

When measuring arches above a door way or an arched window, it is necessary to climb a ladder and perform measurements. Typically, paper is taken up the ladder and attached to the window or doorway with pins, and then the designer must trace the arch pattern outline on the paper. The paper is unwieldy, difficult to position, susceptible to tearing and generally difficult to work with effectively. The designer then returns to the floor surface and lays the tracing out on a second drawing surface in order to form a template for design of a door arch, window arch or the like.

Various devices have heretofore been proposed for measuring an arched doors or windows by employing a trigonometric measuring device for obtaining measurements of arched doors or windows particularly in difficult positions, such as high places where standing upon a ladder and for creating a template suitable for design and installation of window treatments, for example. Other devices employ a window shade with a measurement guide while other devices use an arched blind for semi-circular arched doors or windows.

Yet, other methods include tracing the curvature of the arched door or window with a piece of paper. However, this is generally not accurate since the paper can shift particularly if using a ladder to measure the arch. These and other devices and methods present relatively complicated structures.

While some or all of the above-referenced devices may well be utilized for measuring, many are highly complicated and do not adequately provide a device suitably convenient or effective for measuring arched door or windows and for creating a template thereof.

Accordingly, a need remains for a hand-held tool for measuring an arcuate curvature in order to overcome at least one aforementioned shortcoming. The exemplary embodiment(s) satisfy such a need by providing a hand-held tool for measuring an arcuate curvature associated with a window or door, for example, that is convenient and easy to use, lightweight yet durable in design, versatile in its applications, and designed for assisting a user to layout the radius of the arcuate curvature on a cutting surface.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an adjustable arch measuring tool for measuring an arcuate curvature of one of a window and a door thereby assisting a user to layout a radius of the arcuate curvature on an existing cutting surface. These and other objects, features, and advantages of the non-limiting exemplary embodiment(s) are provided by an adjustable arch measuring tool including a first member having an arcuate slot defining an adjustable fulcrum axis formed at a proximal end thereof, a second member having an aperture formed at a proximal end thereof, and a fastener removably inserted through the aperture and selectively locked along a curvilinear longitudinal length of the arcuate slot. The first member has a first linear longitudinal length and the second member has a second linear longitudinal length, wherein the first linear longitudinal length is substantially equal to the second linear longitudinal length. Advantageously, the second member is selectively pivoted about the adjustable fulcrum axis defined along the arcuate slot of the first member.

In a non-limiting exemplary embodiment, the adjustable fulcrum axis has an arcuate shape. Notably, each of the first member and the second member is linear and planar.

In a non-limiting exemplary embodiment, the first member is pivotally coupled to the second member. Advantageously, the second member is articulated along a 180-degree arcuate path relative to the first member.

In a non-limiting exemplary embodiment, the 180-degree arcuate path is guided along the curvilinear longitudinal length of the arcuate slot.

In a non-limiting exemplary embodiment, the tool further includes a first auxiliary member detachably mated to the first member and configured at a first end-to-end linear pattern therewith.

In a non-limiting exemplary embodiment, the tool further includes a second auxiliary member detachably mated to the second member and configured at a second end-to-end linear pattern therewith.

In a non-limiting exemplary embodiment, the arcuate slot is semi-circular in shape and extends along 180 degrees. In this manner, the arcuate slot has a starting point and an ending point defined parallel to a centrally registered longitudinal axis of the first member.

In a non-limiting exemplary embodiment, the curvilinear longitudinal length begins from the starting point and terminates at the ending point.

In a non-limiting exemplary embodiment, the first member is registered perpendicular to the second member when the fastener is positioned at a half-way point intermediately between the starting point and the ending point of the arcuate slot.

The present disclosure further includes a method of utilizing a tool for measuring an arcuate curvature of one of a window and a door thereby assisting a user to layout a radius of the arcuate curvature on an existing cutting surface. Such a method includes the steps of: obtaining a first member having an arcuate slot defining an adjustable fulcrum axis formed at a proximal end thereof; and obtaining a second member having an aperture formed at a proximal end thereof. Such a first member has a first linear longitudinal length and the second member has a second linear longitudinal length, wherein the first linear longitudinal length is substantially equal to the second linear longitudinal length.

The method further includes the steps of: obtaining and removably inserting a fastener through the aperture; selectively pivoting the second member about the adjustable fulcrum axis defined along the arcuate slot of the first member; and selectively locking the aperture along a curvilinear longitudinal length of the arcuate slot.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 13:
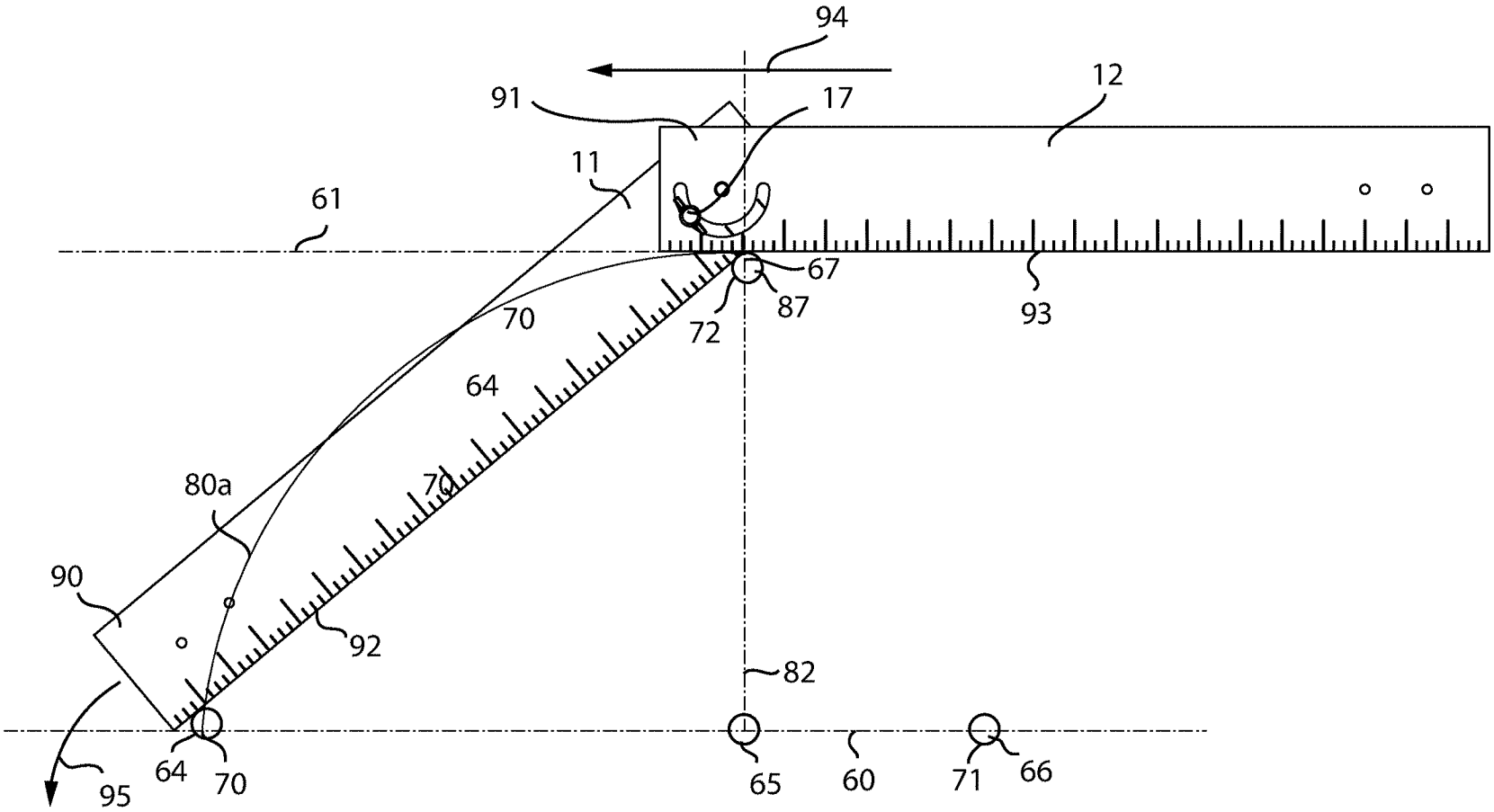
Figure 14:
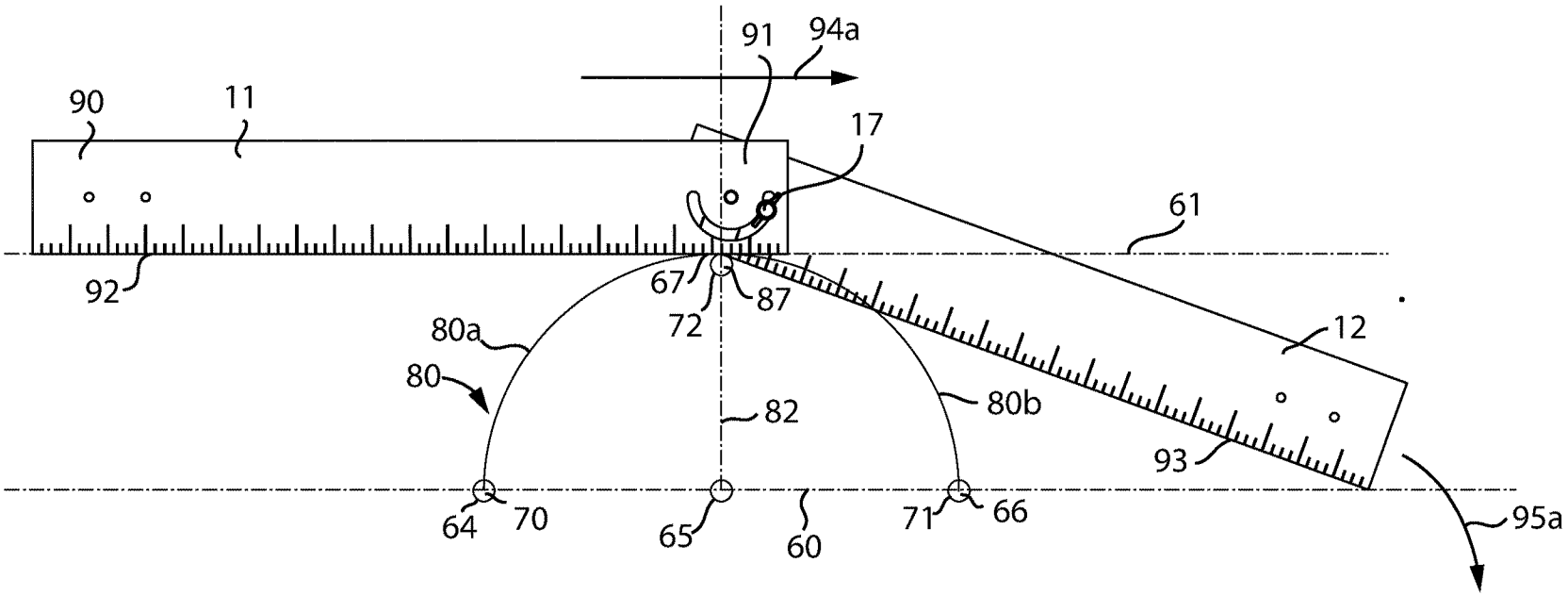

FIG. 13 is a top plan view illustrating use of the adjustable arch measuring tool along with reference points and reference lines to identify and draw a first half of a window/door arch directly on a working surface; and FIG. 14 is a top plan view illustrating use of the adjustable arch measuring tool along with reference points and reference lines to identify and draw a second half of a window/door arch directly on a working surface, and thereby completing the arch (e.g., semi-circle).

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary emboidment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means ±15% of the numerical.

If used herein, "substantially" means largely if not wholly that which is specified but so close that the difference is insignificant.

Figure 7:
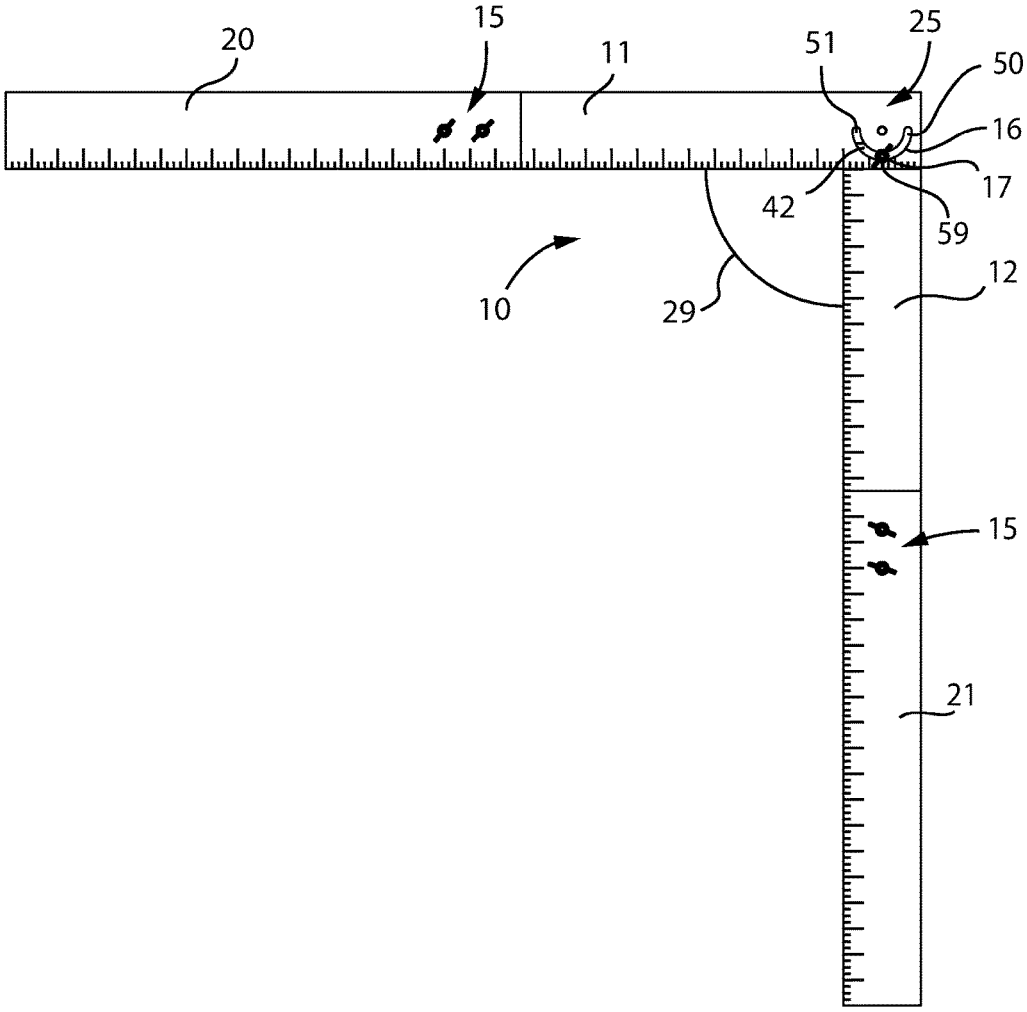
FIG. 7 is a top plan view of a lengthened adjustable arch measuring tool configured at 90 degrees wherein the first member and the second member are registered perpendicular to each other and the fastener is displaced midway at an intermediary location between the starting point and ending point of the arcuate slot, in accordance with another non-limiting exemplary embodiment.
Figure 8:
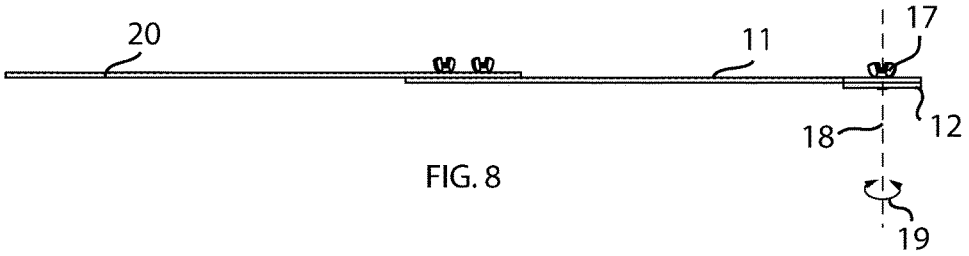
FIG. 8 is a front elevational view of the adjustable arch measuring tool shown in FIG. 7.

The non-limiting exemplary embodiment(s) is/are referred to generally in FIGS. 1-14 and is/are intended to provide an adjustable arch measuring tool 10 for measuring an arcuate curvature of one of a window and a door thereby assisting a user to layout a radius of the arcuate curvature on an existing cutting surface. The adjustable arch measuring tool 10 can be configured in a variety of angles. For example, FIG. 2 is a top plan view showing the adjustable arch measuring tool 10 configured at 90 degrees wherein the first member 11 and the second member 12 are registered perpendicular to each other and the fastener 17 is displaced midway (at an intermediary location 59) between a starting point 50 and ending point 51 of the arcuate slot 16, in accordance with a non-limiting exemplary embodiment. Likewise, FIG. 7 is a top plan view showing a lengthened embodiment of the adjustable arch measuring tool 10 configured at 90 degrees wherein the first member 11 and the second member 12 are registered perpendicular to each other and the fastener 17 is displaced midway (at an intermediary location 59) between the starting point 50 and ending point 51 of the arcuate slot 16, in accordance with another non-limiting exemplary embodiment.

Figure 1:
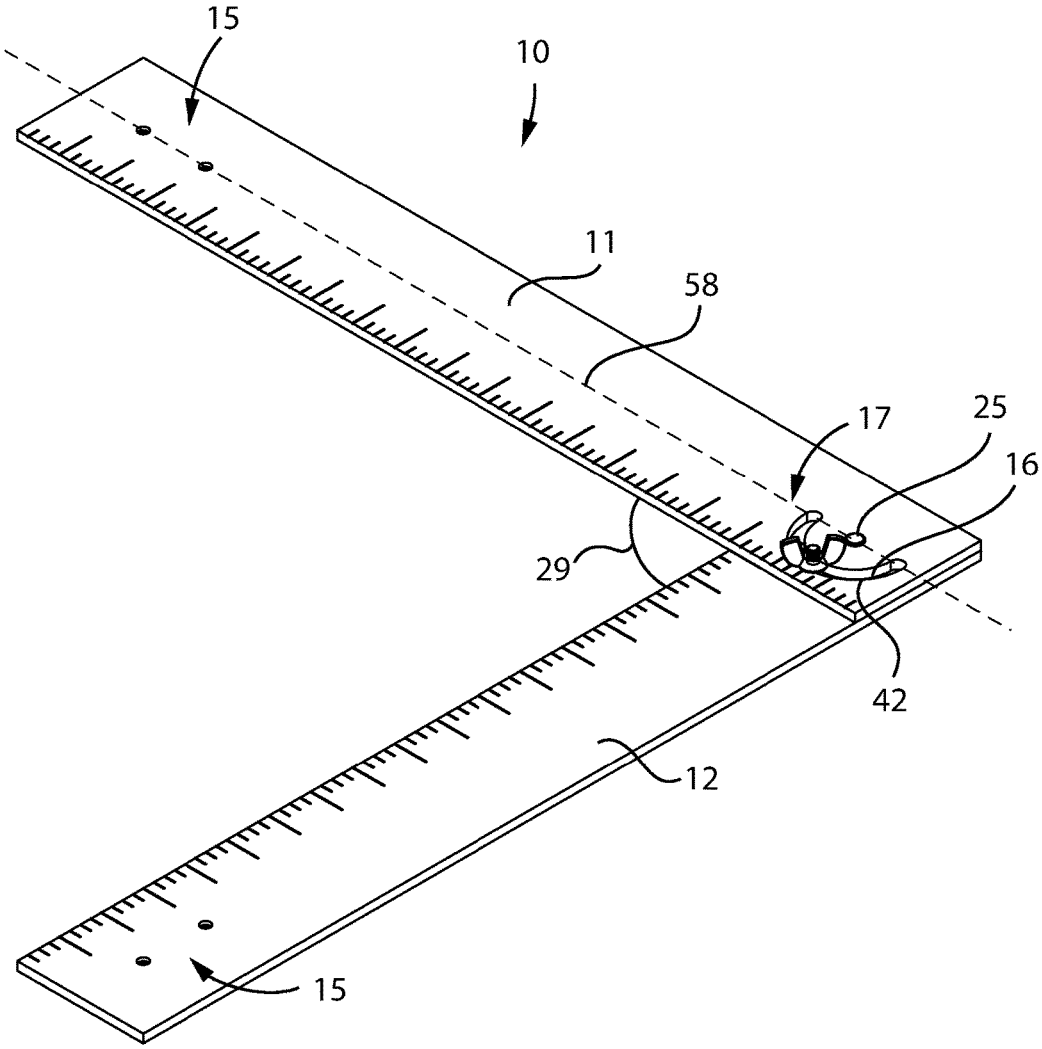
FIG. 1 is a perspective view of an adjustable arch measuring tool configured at 90 degrees wherein the first member and the second member are registered perpendicular to each other and the fastener is displaced midway at an intermediary location between the starting point and ending point of the arcuate slot, in accordance with a non-limiting exemplary embodiment.
Figure 2:
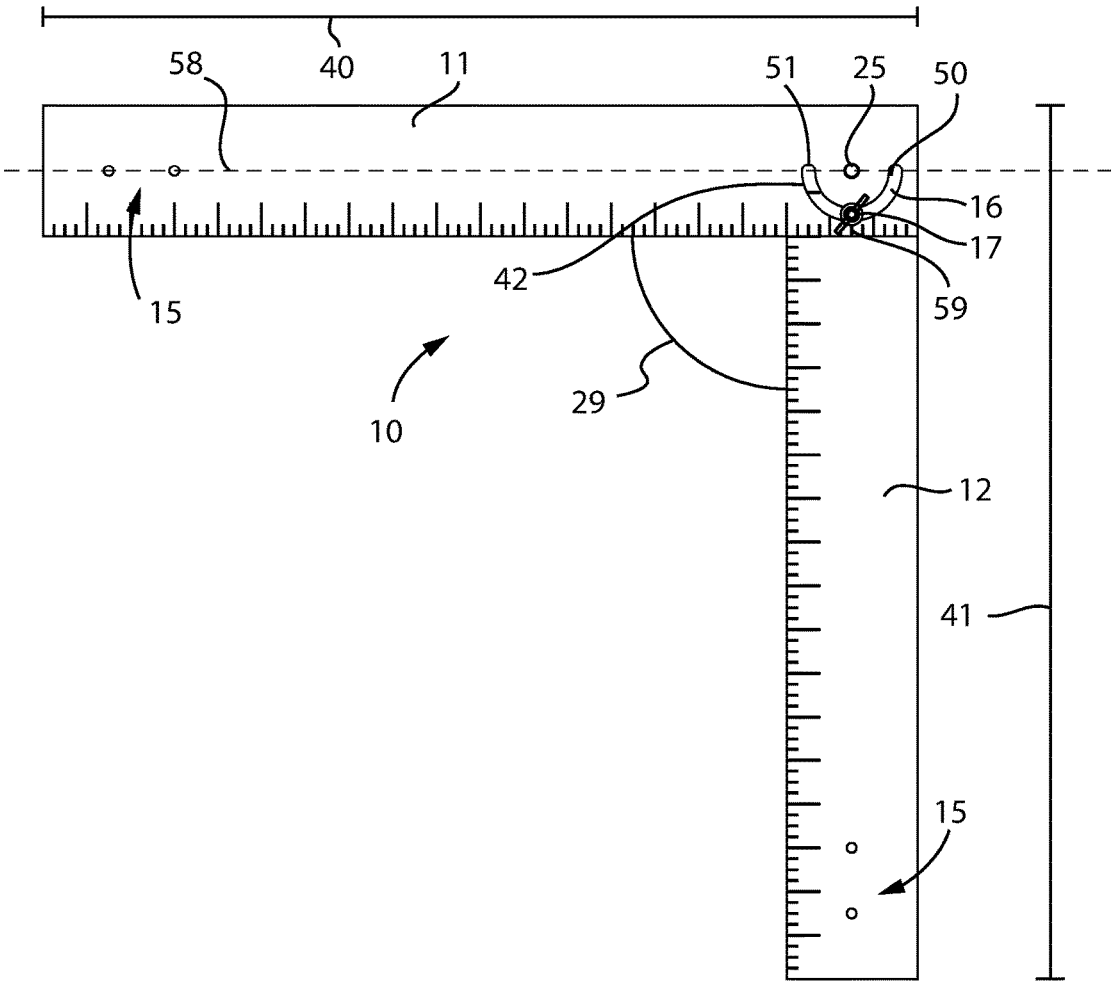
FIG. 2 is a top plan view of the adjustable arch measuring tool shown in FIG. 1.
Figure 3:
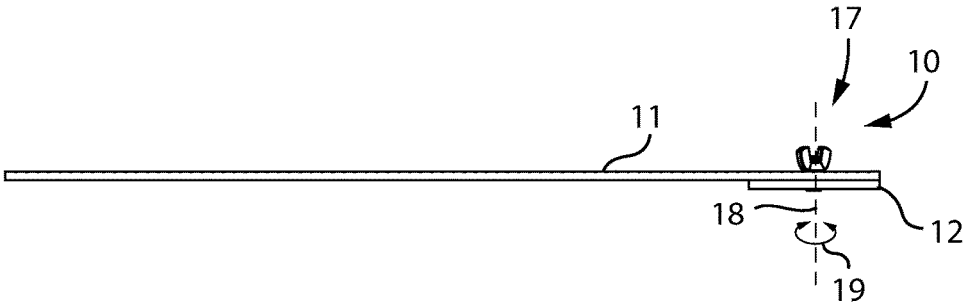
FIG. 3 is a front elevational view of the adjustable arch measuring tool shown in FIG. 1.
Figure 4:
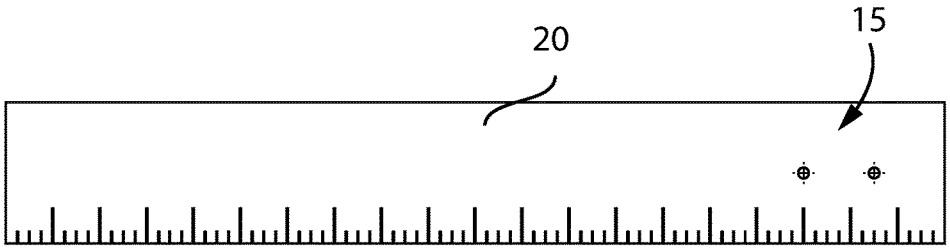
FIG. 4 is a top plan view of an auxiliary member removably attachable to the first and second members shown in FIG. 1.
Figure 5:
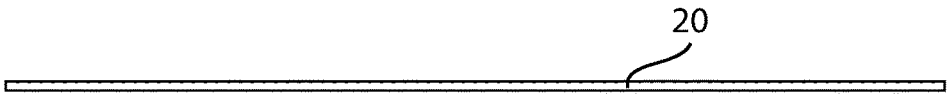
FIG. 5 is a front elevational view of the auxiliary member shown in FIG. 1.
Figure 6:
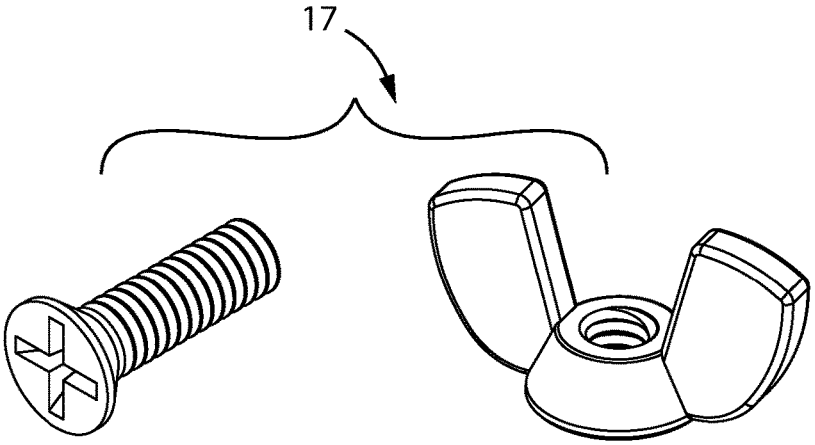
FIG. 6 is an enlarged exploded view of the fastener shown in FIG. 1.
Figure 9:
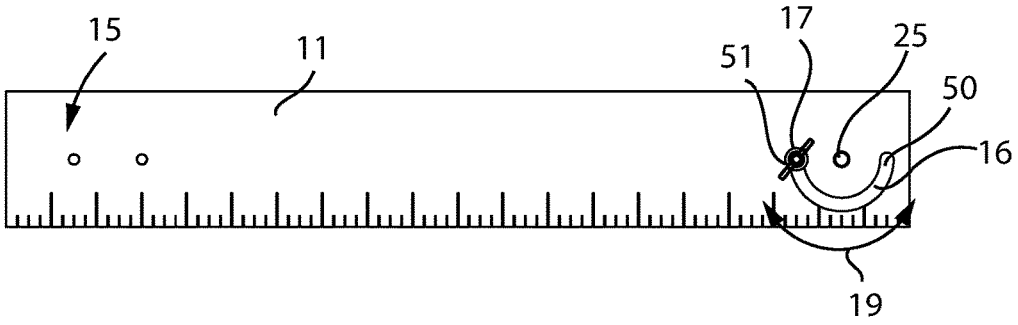
FIG. 9 is a top plan view illustrating the tool of FIG. 1 configured at 0 degrees wherein the first member and the second member are registered parallel to each other and the fastener is displaced to the ending point of the arcuate slot.
Figure 10:
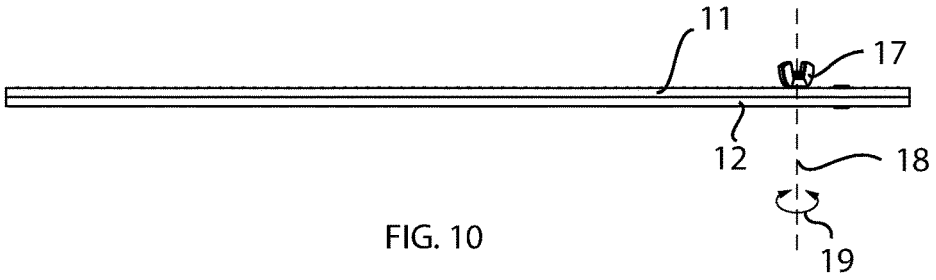
FIG. 10 is a front elevational view of the tool configuration shown in FIG. 9.
Figure 11:
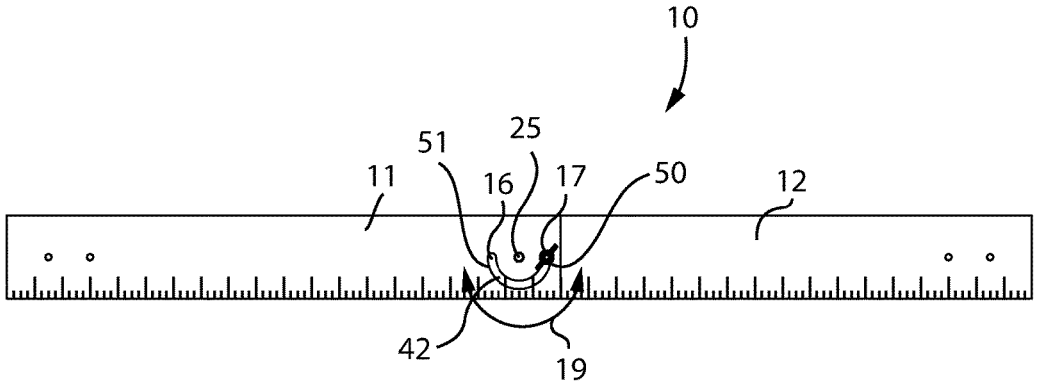
FIG. 11 is a top plan view illustrating the tool of FIG. 1 configured at 180 degrees wherein the first member and the second member are registered parallel to each other and the fastener is displaced to the starting point of the arcuate slot.
Figure 12:
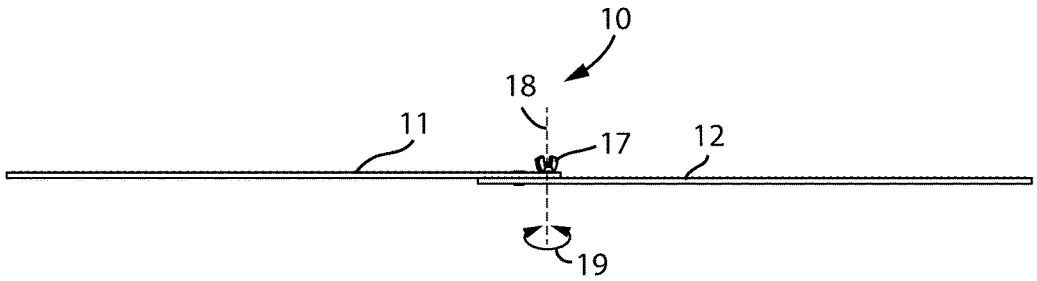
FIG. 12 is a front elevational view of the tool configuration shown in FIG. 11.

FIG. 9 is a top plan view illustrating the adjustable arch measuring tool 10 of FIG. 1 configured at 0 degrees wherein the first member 11 and the second member 12 are registered parallel (overlapping) to each other and the fastener 17 is displaced to the ending point 51 of the arcuate slot 16. FIG. 11 is a top plan view illustrating the adjustable arch measuring tool 10 of FIG. 1 configured at 180 degrees wherein the first member 11 and the second member 12 are registered parallel (substantially non-overlapping) to each other and the fastener 17 is displaced to the starting point 50 of the arcuate slot 16. Of course, the tool 10 can be adjustably locked at a variety of angled measured between 0 and 180 degrees 19.

The adjustable arch measuring tool 10 includes a first member 11 having an arcuate slot 16 defining an adjustable fulcrum axis 18 (selectively positional along arcuate slot 16) formed at a proximal end thereof, a second member 12 having an aperture 25 formed at a proximal end thereof, and a fastener 17 removably inserted through the aperture 25 and selectively locked along a curvilinear longitudinal length 42 of the arcuate slot 16. The first member 11 has a first linear longitudinal length 40 and the second member 12 has a second linear longitudinal length 41, wherein the first linear longitudinal length 40 is substantially equal to the second linear longitudinal length 41. Advantageously, the second member 12 is selectively pivoted about the adjustable fulcrum axis 18 (selectively positional along arcuate slot 16 via fastener 17) defined along the arcuate slot 16 of the first member 11.

In a non-limiting exemplary embodiment, the adjustable fulcrum axis 18 has an arcuate shape. The term arcuate shape means the adjustable fulcrum axis 18 can be selectively positioned along the arcuate shape of arcuate slot 16 via fastener 17). Notably, each of the first member 11 and the second member 12 is linear and planar.

In a non-limiting exemplary embodiment, the first member 11 is pivotally coupled to the second member 12. Advantageously, the second member 12 is articulated along a 180-degree arcuate path 19 relative to the first member 11.

In a non-limiting exemplary embodiment, the 180-degree arcuate path 19 is guided along the curvilinear longitudinal length 42 of the arcuate slot 16. Thus, as the second member 12 pivots relative to the first member 11, and visa-versa, the 180-degree arcuate path 19 is positional along various points of the arcuate slot 16.

In a non-limiting exemplary embodiment, as perhaps best shown in FIG. 7, the tool 10 further includes a first auxiliary member 20 detachably mated to the first member 11 and configured at a first end-to-end linear pattern therewith.

In a non-limiting exemplary embodiment, as perhaps best shown in FIG. 7, the tool 10 further includes a second auxiliary member 21 detachably mated to the second member 12 and configured at a second end-to-end linear pattern therewith.

In a non-limiting exemplary embodiment, the arcuate slot 16 is semi-circular in shape and extends along 180 degrees 19. In this manner, the arcuate slot 16 has a starting point 50 and an ending point 51 defined parallel to a centrally registered longitudinal axis 58 of the first member 11.

In a non-limiting exemplary embodiment, the curvilinear longitudinal length 42 begins from the starting point 50 and terminates at the ending point 51.

In a non-limiting exemplary embodiment, the first member 11 is registered perpendicular to the second member 12 when the fastener 17 is positioned at a half-way point 59 intermediately between the starting point 50 and the ending point 51 of the arcuate slot 16.

The present disclosure further includes a method of utilizing a tool 10 for measuring an arcuate curvature of one of a window and a door thereby assisting a user to layout a radius of the arcuate curvature on an existing cutting surface. Such a method includes the steps of: obtaining a first member 11 having an arcuate slot 16 defining an adjustable fulcrum axis 18 formed at a proximal end thereof; and obtaining a second member 12 having an aperture 25 formed at a proximal end thereof. Such a first member 11 has a first linear longitudinal length 40 and the second member 12 has a second linear longitudinal length 41, wherein the first linear longitudinal length 40 is substantially equal to the second linear longitudinal length 41.

The method further includes the steps of: obtaining and removably inserting a fastener 17 through the aperture 25; selectively pivoting the second member 12 about the adjustable fulcrum axis 18 defined along the arcuate slot 16 of the first member 11; and selectively locking the aperture 25 along a curvilinear longitudinal length 42 of the arcuate slot 16.

In a non-limiting exemplary embodiment, the tool 10 can be used in the following manner for measuring an arcuate curvature of a window or a door thereby assisting a user to layout a radius of the arcuate curvature directly on an existing cutting surface. With reference to at least FIGS. 13 and 14, draw a horizontal bottom line 60 at a base of the window/door arch 80 and also draw a horizontal top line 61 at an apex 62 of the arch 80. The horizontal top line 61 is parallel to the horizontal bottom line 60. At the horizontal bottom line 60, mark each end of the arch 80 as well as the middle of the arch 80. For example, a three-foot diameter arch 80 will have a first end point 64 at a zero reference point, a middle point 65 at 1.5 feet, and a second end point 66 at 3.0 feet.

From the middle point 65, draw a vertical line 82 to the intersection, (e.g., inner elbow 67) of the first member 11 and second member 12. Insert three pins (e.g., tags, markers, etc.) at the first end point 64 (e.g., first pin 70), second end point 66 (e.g., second pin 71) and the inner elbow 67 (e.g., third pin 72). Align one of the first member 11 and second member 12 along the horizontal top line 61 such that the member 11 or 12 is parallel to the horizontal to line 61, and the inner elbow 67 is abutted against the third pin 72. Rotatably articulate a distal end 90 of the non-horizontal member (e.g., either 11 or 12) until its distal end 90 reaches either the first pin 70 (first end point 64 at the zero reference point) or second pin 71 (second end point 66 at the 3.0-foot reference point). Now tighten the fastener 17 along the arcuate slot 16 so the first member 11 is statically coupled to the second member 12 and maintains a fixed angle therebetween.

Place a writing utensil 87 at the inner elbow 67/third pin 72. Make sure either the first pin 70 or second pin 71 is directly abutted against an inside linear edge 92 of the non-horizontal member (e.g., either 11 or 12) while the third pin 72 is directly abutted against the inner elbow/third pin 72. While maintaining the writing utensil 87 statically positioned at the inner elbow 67/third pin 72, simultaneously glide the inside linear edge 93 of the horizontally aligned member (e.g., 11 and 12) along the third pin 72 (along a linear horizontal direction 94 parallel to the horizontal top line 61), and arcuately glide (along arcuate direction 95) the inside linear edge 92 of the non-horizontal member (e.g., either 11 or 12) along either the first pin 70 or second pin 71. This causes the writing utensil to draw one-half 80*a* or 80*b* of the window/door arch 80. For example, one-half 80*a* of the arch 80 will be drawn from the third pin 72 to either first pin 70 at the zero reference point 64 or the second pin 71 at the 3.0-foot reference point 66.

With reference to FIG. 14, repeat the above steps shown in FIG. 13 but in the opposite direction by horizontally aligning the initially non-horizontal member (e.g. 11 or 12) parallel to the horizontal top line 61 with the inner elbow 67 abutted against the third pin 72. Like above, simultaneously glide the writing utensil 87 with the inside linear edges 92 and 93 along the corresponding pins 72 and 70/71 while maintaining direct contact therewith. For example, first member 11 is displaced along linear direction 94*a* and second member 12 is arcuately displaced along arcuate direction 95*a*. This will draw the remaining half 80*b* or 80*a* of the arch 80 from the third pin 72 to either first pin 70 at the zero reference point 64 or the second pin 71 at the 3.0-foot reference point 66.

Referring again to FIGS. 1-14 in general, in a non-limiting exemplary embodiment(s), a hand-held tool 10 is capable of measuring an arcuate curvature associated with a window or door, for example, thereby assisting a user to layout the radius of the arcuate curvature on a cutting surface. In this manner, the user is able to quickly reproduce the arcuate curvature without having to use a tape measure, string, etc. The hand-held tool 10 includes a first member 11 pivotally coupled to a second member 12, wherein the second member 12 is articulated along a 180-degree angle (arcuate path) 19 relative to the first member 11. Of course, the first member 11 can be pivoted along the 180-degree angle 19 relative to the second member 12. For example, the first member 11 can be disposed perpendicular to the second member 12, parallel thereto or at any angle ranging between 0-180 degrees 29. One or more of the first and second members 11, 12 may be linearly extended/retracted. Such lengthening/shortening may be achieved via telescopic means or other conventional means. For example, each member 11, 12 may include apertures 15 formed at respective distal ends thereof for auxiliary extensions 20, 21.

Notably, the first member 11 has an arcuate slot 16 formed at a proximal end thereof. Such an arcuate lot 16 is suitably sized and shaped for receiving a wing nut, or other fastener 17, therethrough. The arcuate slot 16 is semi-circular in shape and extends along 180 degrees. The second member 12 includes an aperture 25 formed at a proximal end thereof. The fastener 17 is inserted through the aperture 25 and selectively locked along a longitudinal length of the arcuate slot 16. Advantageously, the second member 12 pivots about an adjustable fulcrum axis 18 defined along the arcuate slot 16. Notably, an adjustable fulcrum axis 18 about which one linear member is pivotal relative to another linear member. Surface indicia may be provided on a top surface of the first member 11 to identify a perpendicular position with respect to an edge of the second member 12.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An adjustable arch measuring tool for measuring an arcuate curvature of one of a window and a door thereby assisting a user to layout a radius of the arcuate curvature on an existing cutting surface, said tool comprising:

a first member having an arcuate slot defining an adjustable fulcrum axis formed at a proximal end thereof;

a second member having an aperture formed at a proximal end thereof; and a fastener removably inserted through said aperture and selectively locked along a curvilinear longitudinal length of said arcuate slot;

wherein said second member is selectively pivoted about said adjustable fulcrum axis defined along said arcuate slot of said first member.

2. The adjustable arch measuring tool of claim 1, wherein said adjustable fulcrum axis has an arcuate shape, wherein each of said first member and said second member is linear and planar.

3. The adjustable arch measuring tool of claim 1, wherein said first member is pivotally coupled to said second member, wherein said second member is articulated along a 180-degree arcuate path relative to said first member.

4. The adjustable arch measuring tool of claim 3, wherein said 180-degree arcuate path is guided along said curvilinear longitudinal length of said arcuate slot.

5. The adjustable arch measuring tool of claim 1, further comprising: a first auxiliary member detachably mated to said first member and configured at a first end-to-end linear pattern therewith.

6. The adjustable arch measuring tool of claim 5, further comprising: a second auxiliary member detachably mated to said second member and configured at a second end-to-end linear pattern therewith.

7. The adjustable arch measuring tool of claim 1, wherein said arcuate slot is semi-circular in shape and extends along 180 degrees, said arcuate slot having a starting point and an ending point defined parallel to a centrally registered longitudinal axis of said first member.

8. The adjustable arch measuring tool of claim 7, wherein said curvilinear longitudinal length begins from said starting point and terminating at said ending point.

9. The adjustable arch measuring tool of claim 8, wherein said first member is registered perpendicular to said second member when said fastener is positioned at a half-way point intermediately between said starting point and said ending point of said arcuate slot.

10. An adjustable arch measuring tool for measuring an arcuate curvature of one of a window and a door thereby assisting a user to layout a radius of the arcuate curvature on an existing cutting surface, said tool comprising:

a first member having an arcuate slot defining an adjustable fulcrum axis formed at a proximal end thereof;

a second member having an aperture formed at a proximal end thereof; and a fastener removably inserted through said aperture and selectively locked along a curvilinear longitudinal length of said arcuate slot;

wherein said second member is selectively pivoted about said adjustable fulcrum axis defined along said arcuate slot of said first member;

wherein said first member has a first linear longitudinal length and said second member has a second linear longitudinal length;

wherein said first linear longitudinal length is substantially equal to said second linear longitudinal length.

11. The adjustable arch measuring tool of claim 10, wherein said adjustable fulcrum axis has an arcuate shape, wherein each of said first member and said second member is linear and planar.

12. The adjustable arch measuring tool of claim 11, wherein said first member is pivotally coupled to said second member, wherein said second member is articulated along a 180-degree arcuate path relative to said first member.

13. The adjustable arch measuring tool of claim 12, wherein said 180-degree arcuate path is guided along said curvilinear longitudinal length of said arcuate slot.

14. The adjustable arch measuring tool of claim 13, further comprising: a first auxiliary member detachably mated to said first member and configured at a first end-to-end linear pattern therewith.

15. The adjustable arch measuring tool of claim 14, further comprising: a second auxiliary member detachably mated to said second member and configured at a second end-to-end linear pattern therewith.

16. The adjustable arch measuring tool of claim 15, wherein said arcuate slot is semi-circular in shape and extends along 180 degrees, said arcuate slot having a starting point and an ending point defined parallel to a centrally registered longitudinal axis of said first member.

17. The adjustable arch measuring tool of claim 16, wherein said curvilinear longitudinal length begins from said starting point and terminating at said ending point.

18. The adjustable arch measuring tool of claim 17, wherein said first member is registered perpendicular to said second member when said fastener is positioned at a half-way point intermediately between said starting point and said ending point of said arcuate slot.

19. A method of utilizing an adjustable arch measuring tool for measuring an arcuate curvature of one of a window and a door thereby assisting a user to layout a radius of the arcuate curvature on an existing cutting surface, said method comprising the steps of:

obtaining a first member having an arcuate slot defining an adjustable fulcrum axis formed at a proximal end thereof;

obtaining a second member having an aperture formed at a proximal end thereof, wherein said first member has a first linear longitudinal length and said second member has a second linear longitudinal length, wherein said first linear longitudinal length is substantially equal to said second linear longitudinal length;

obtaining and removably inserting a fastener through said aperture;

selectively pivoting said second member about said adjustable fulcrum axis defined along said arcuate slot of said first member; and selectively locking said aperture along a curvilinear longitudinal length of said arcuate slot.

* * * * *